US005600887A

United States Patent [19]

Olson

[11] Patent Number: 5,600,887

[45] Date of Patent: Feb. 11, 1997

[54] FLEXIBLE EASY-RINSING RAZOR

[76] Inventor: Brad Olson, 1003 Stitch Rd., Lake Stevens, Wash. 98258

[21] Appl. No.: 451,755

[22] Filed: May 26, 1995

[51] Int. Cl.[6] ..... B26B 19/44; B26B 21/14

[52] U.S. Cl. ..... 30/41.5; 30/527

[58] Field of Search ..... 30/41, 41.5, 47, 30/50, 86, 87, 90

[56] References Cited

U.S. PATENT DOCUMENTS

| | | | |
|---|---|---|---|
| 1,852,708 | 4/1932 | Stuart . | |
| 2,336,806 | 12/1943 | Schenk et al. | 30/41 |
| 2,715,767 | 8/1955 | Van Heest . | |
| 4,227,302 | 10/1980 | Torrance | 30/47 |
| 4,228,586 | 10/1980 | Thierry . | |
| 4,480,387 | 11/1984 | d'Alayer de Costemore d'Arc . | |
| 4,640,012 | 2/1987 | Thomas . | |
| 4,868,982 | 9/1989 | McComas | 30/41 |
| 4,941,492 | 7/1990 | Morgan . | |
| 5,038,472 | 8/1991 | Iderosa | 30/87 |
| 5,265,337 | 11/1993 | Lowder | 30/41.5 |

FOREIGN PATENT DOCUMENTS

| | | | |
|---|---|---|---|
| 69519 | 7/1949 | Denmark | 30/87 |
| 3635552 | 4/1988 | Germany | 30/41 |
| 2066134 | 7/1981 | United Kingdom | 30/87 |

*Primary Examiner*—Hwei-Siu Payer

*Attorney, Agent, or Firm*—Christensen, O'Connor, Johnson & Kindness PLLC

[57] ABSTRACT

A flexible, easy-to-rinse razor (10), formed in accordance with the present invention, is provided. The razor includes a blade cartridge (16) having a pair of opposing ends (17), an elongated handle (12), a flexible neck (22) coupled to the handle, and a pair of mounting arms (18) extending from the neck and securing the ends of the blade cartridge. In the preferred embodiment, the flexible neck can be protracted into and retracted from the handle by turning a rotatable cuff (36) coupled to the handle. In yet another embodiment of the present invention, the razor is provided with a flume (28) attached to the flexible neck that is capable of converting a normal circular-shaped water stream into a substantially rectangular-shaped stream and directing the substantially rectangular-shaped stream through the blade cartridge.

23 Claims, 3 Drawing Sheets

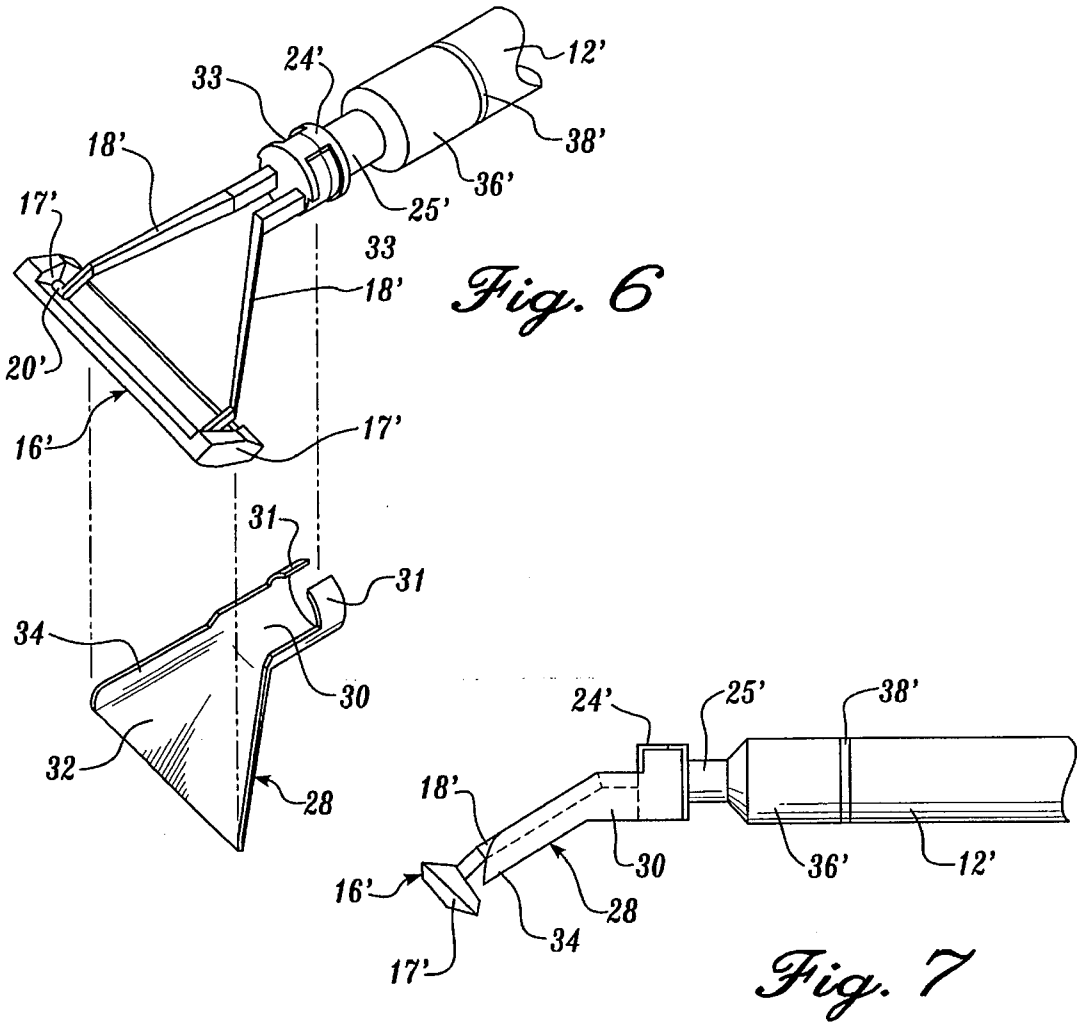
Fig. 6
Fig. 7
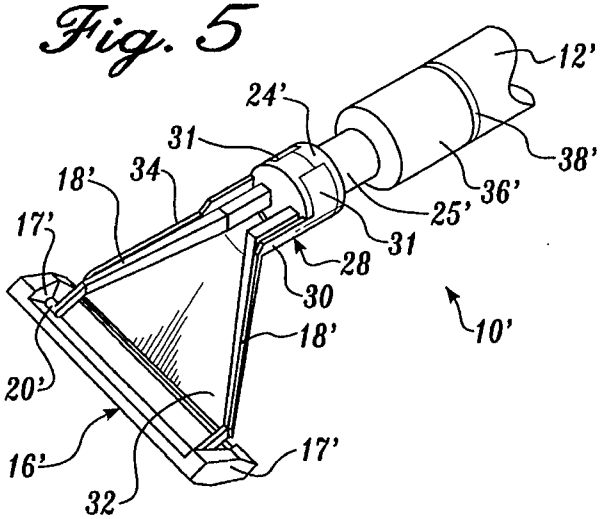
Fig. 5

FLEXIBLE EASY-RINSING RAZOR

FIELD OF THE INVENTION

This invention relates to the general field of razors. More specifically, the invention relates to a razor having a blade cartridge attached to an elongated handle with a flexible neck, and a flume attached between the handle and the blade cartridge to direct a stream of water into the blade cartridge.

BACKGROUND OF THE INVENTION

Razors include a blade cartridge that is either permanently or removably attached at its center to an elongated handle. Although the industry has attempted to distinguish and improve this basic configuration, conventional razors continue to suffer from the same limitations and disadvantages. For example, conventional razors are difficult to rinse clean. Typically, the user will clean the blade cartridge by either dipping the blade cartridge in water or holding the razor under a stream of freely flowing water. However, most of the water used to rinse the razor simply splashes over the sides of the blade cartridge. In addition, the handle and the cartridge connectors form obstructions that prevent water from flowing onto and between the blades. Consequently, shaving debris accumulates rapidly in the blade cartridge, requiring frequent replacement of the blade cartridge or the entire razor.

Various attempts have been made to facilitate cleaning and rinsing of the blade cartridge. For example, U.S. Pat. No. 4,640,012 to Thomas describes a razor having a pair of water passages extending lengthwise through the blade cartridge for channeling water along the blade or blades. U.S. Pat. No. 1,852,708 to Smart discloses a razor that is rinsed by water that is channeled axially through the handle to a blade. However, all of these known razors have the same basic configuration, i.e., handle attachments which obstruct the flow of water through the blade cartridge.

In addition to improving cleaning, attempts have been made to improve the flexibility of known razors so that they provide a safer, closer shave. In order to safely and effectively shave rugged and/or varying shaving surfaces, the blades of the blade cartridge must maintain stable contact with the shaving surface. This becomes increasingly difficult if the shaving surface is contoured, or if the user cannot maintain a steady hand. Accordingly, some conventional razors include a blade cartridge that pivots to a desired angle with the shaving surface or flexes in conformance with shaving surface contours. Although somewhat effective when used with relatively smooth surfaces, such razors are much less effective and safe when used on sharply curved or rough surfaces, where the risk of injury is much greater.

SUMMARY OF THE INVENTION

The present invention provides a highly flexible, safe, easy-to-rinse razor that can be used by any person on any shaving surface. The problems inherent in prior designs are overcome by securing the blade cartridge at the ends of the cartridge, rather than the middle, by mounting arms that flare from the handle to the cartridge. Water used to rinse the razor flows unimpeded between and around the blades of the blade cartridge. In one embodiment, a flume is provided that directs the water into the blade cartridge. As water flows into the flume, it assumes a rectangular shape corresponding to the shape of the blade cartridge, reducing the amount of water that washes over the sides of the blade cartridge and increasing the amount of water that flows unimpeded through the blade cartridge.

Further, the razor of the present invention exhibits a greater degree of flex so that the blade cartridge of the razor can adapt to a wide variety of shaving surfaces, providing a closer shave and reducing the risk of injury. Preferably, the handle of the razor has a flexible neck from which the mounting arms extends.

The neck is adjustably mounted to the first end of the handle by a rotatable cuff. The cuff is coupled to the first end of the handle such that the threaded pin of the neck extends through the cuff and into the handle. The cuff includes a threaded inner surface that engages the threaded pin such that rotating the cuff propels the threaded pin through the cuff and moves the flexible stem of the neck into and out of the cuff Other embodiments of the present invention include a hollow handle for storing grooming accessories and a removable cap attached to the second end of the hollow handle. In some embodiments, the removable cap can be provided with a grooming accessory, such as an antiseptic sponge.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 5 is a fragmentary top perspective of the head position of a razor formed in accordance with another improvement for the razor of the present invention, wherein the razor is equipped with a removable flume;

FIG. 6 is a fragmentary top perspective corresponding to FIG. 5, with the flume detached from the razor; and FIG. 7 is a side elevation of the razor and flume illustrated in FIG. 5.

DETAILED DESCRIPTION OF THE PREFERRED EMBODIMENT

Figures 1, 2:
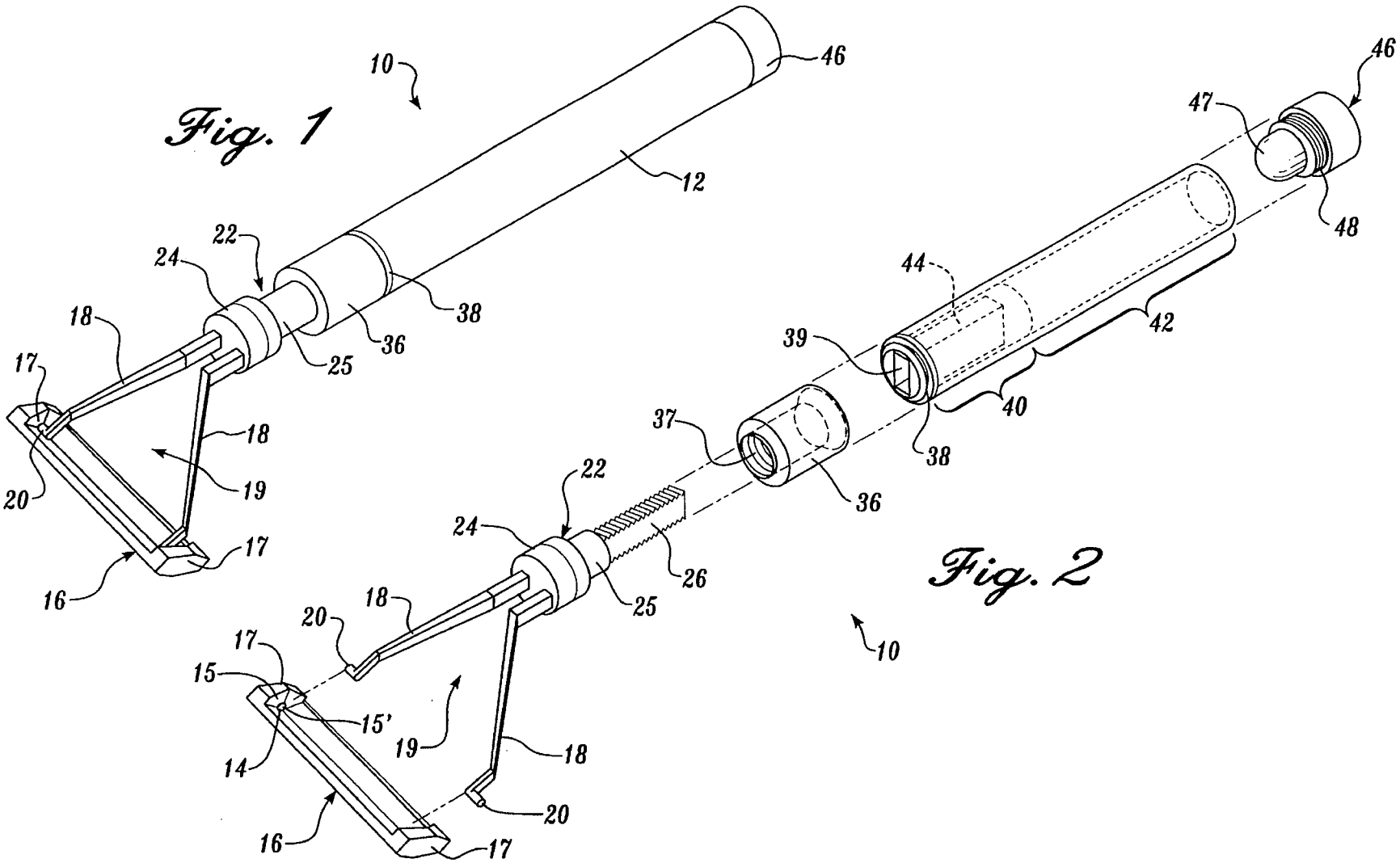
FIG. 1 is a top perspective of a razor having a flexible neck formed in accordance with a first embodiment of the present invention.
FIG. 2 is a top perspective corresponding to FIG. 1, but with parts shown in exploded relationship.

The present invention provides a razor 10 improved for easy rinsing, and having increased flex characteristics for adapting to changing contours of the surface being shaved. In the embodiment illustrated in FIG. 1, the razor 10 includes an elongated handle 12, a neck 22 projecting axially from the handle and terminating at a rigid collar 24, and a pair of mounting arms 18 flaring outwardly from the collar and secured to the opposite ends 17 of a blade cartridge 16. The blade cartridge 16 is generally rectangular in shape, with a longitudinal dimension defined between its opposite ends 17. Cartridge 16 houses one or more blades (not shown), preferably a pair.

As best seen in FIG. 2, the mounting arms 18 protrude from the collar 24 and slope downwardly and away from each other forming a substantially V-shaped space 19 between them. Each mounting arm 18 includes a substantially L-shaped prong 20 at its outer end which is used to secure the ends 17 of the blade cartridge 16 to the arms 18. More specifically, each end 17 of the blade cartridge has a flange 15, with an undercut inner surface 15' that slopes inwardly to a depression or fastening point 14 into which the prong 20 of each mounting arm 18 is inserted, such that the blade cartridge 16 is still allowed to pivot at the fastening points 14. However, the blade cartridge 16 is biased to a central position when not in use. The inner ends of the mounting arms 18 are held by the rigid collar 24, but the outer ends are movable due to the inherent resiliency of the arms. The blade cartridge 16 is secured to the razor 10 by the force being exerted against the end flanges 17 of the blade cartridge 16 by the mounting arms 18.

In the preferred embodiment, the blade cartridge 16 is disposable and can be removed from the razor 10 by simply pressing the mounting arms 18 toward each other to free the prongs 20 from the fastening points 14. Similarly, the blade cartridge 16 can be attached to the razor 10 by pressing the mounting arms 18 toward each other, inserting the prongs 20 to a position close to the fastening points 14 and releasing the arms. The sloped inner surfaces of the cartridge and flanges 15 guide the prongs to the fastening points. However, those of ordinary skill in the art will recognize that the blade cartridge 16 may also be permanently attached to the mounting arms 18. Further, the configuration of the mounting arms 18 may vary without departing from the scope of this invention. For example, the mounting arms 18 may extend from the collar 24 and curve outward in opposing directions, forming a substantially C-shaped space between the arms. Finally, the mounting arms 18 and collar 24 are preferably made of light-weight surgical steel. However, any strong, rust-resistant material may be used.

The advantages to securing the blade cartridge 16 to the razor 10 at the ends 17 of the cartridge, rather than the middle, are numerous. Primarily, it is much easier to rinse the blade cartridge 16 because the water used to rinse the blade cartridge is allowed to flow freely between the blades of the cartridge, unimpeded by any obstruction. In addition, the above-described configuration is much less costly and complicated to manufacture than known razors, and is easy to use and reliable.

In addition to the pivoting blade cartridge 16, preferably the neck 22 has a flexible stem 25 extending between the rigid collar 24 and the handle 12, to permit resilient movement of the blade cartridge 16 to conform to shaving surface contours. The stem 25 is preferably made of a semi-hard rubber or other resilient material, which enables the stem 25 to bend relative to the handle. For example, as the user pulls the razor 10 over a sharp curve, the stem 25 will bend accordingly, maintaining the blade(s) of the blade cartridge 16 in stable contact with the shaving surface. Since the entire stem 25 is made of rubber, the neck 22 can move in all transverse directions from the central position to which it is biased, making the razor 10 highly flexible and adaptable to any shaving surface. In addition, depending on the material used, some limited resilient shortening of the stem is possible by compression. However, the user may want to limit the resiliency of the neck 22 under some circumstances, such as when the user wants to apply more pressure. Accordingly, in the preferred embodiment of the present invention, the degree of resiliency or flex characteristics in the neck 22 is adjustable.

Figures 3, 4:
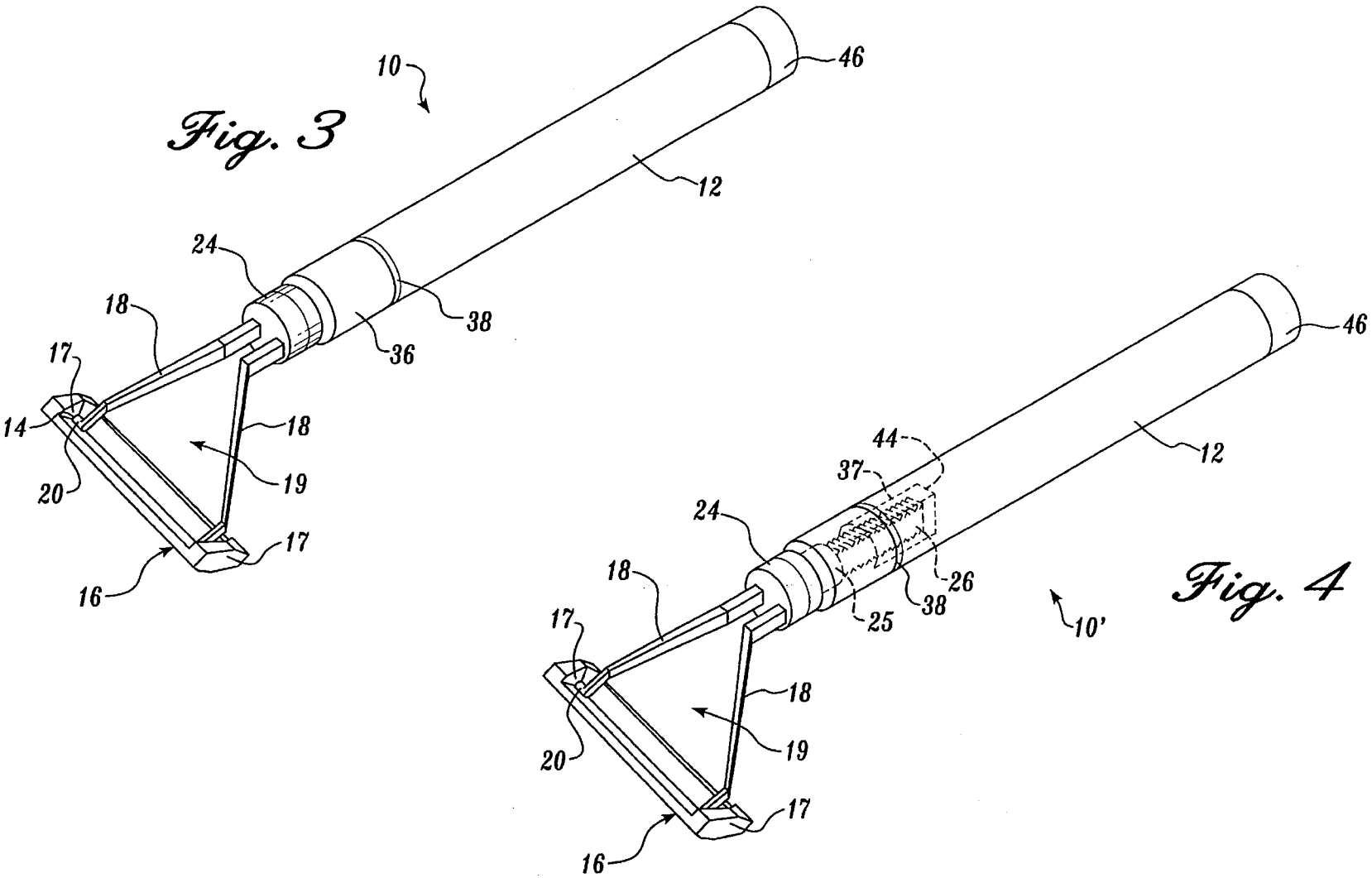
FIG. 3 is a top perspective corresponding to FIG. 1 but parts in different positions.
FIG. 4 is a cross-sectional view of the razor illustrated in FIG. 3.

As shown in FIGS. 2, 3, and 4, the flexible stem 25 has one end secured to the rigid collar 24, the other end is coupled to a partially threaded pin 26 of substantially rectangular cross-section. The partially threaded pin 26 is received in a rotatable cuff 36. A circular joint 38 is provided between the rotatable cuff 36 and the fixed handle 12. The joint 38 includes a lip 35 that snaps into the cuff 36 such that the cuff is allowed to rotate freely about the threaded pin 26 and the lip 35. However, the other end of the joint is fixedly attached to the leading end of the handle so that the handle is not allowed to rotate with respect to the neck 22. The joint 38 contains a rectangular-shaped hole 39 through which the partially threaded pin 26 passes. The front portion 40 of the handle 12 contains an axial blind bore 44 that opens through the leading end of the handle. Bore 44 is of substantially rectangular cross-section, slightly larger than the cross-section of the partially threaded pin 26 so that the partially threaded pin 26 fits snugly but slidably within the bore 44 when inserted into the handle. The remaining rear portion 42 of the handle 12 is hollow and can be used to store various items, such as extra blade cartridges and grooming accessories. In the illustrated embodiment, the hollow portion 42 of the handle 12 is sealed at the rear end by a cap 46. The cap 46 is also provided with an antiseptic sponge 47 and is screwed into the handle 12 by a set of threads 48. When needed, the user need only remove the cap to apply the antiseptic sponge to the affected area. However, it will be readily apparent to those skilled in the art that the cap 46 may be attached to the handle 12 in any number of ways and that the cap 46 may be provided with various types of grooming accessories.

As described above, the razor 10 is assembled so that the partially threaded pin 26 extends through the rotatable cuff 36 and joint 38, and into the bore 44 of the handle 12. When the rotatable cuff 36 is turned in a counterclockwise direction, a threaded inner surface 37 of the cuff 36 engages the partially threaded pin 26 thereby propelling the threaded pin outwardly through the cuff 36 and out of the bore 44 of the handle. Hence, as the threaded pin moves outwardly through the cuff 36, the flexible stem 25 of the neck 22 is projected from the handle 12. Similarly, the flexible stem 25 can be retracted into the handle 12 by rotating the cuff 36 in a clockwise direction such that the threaded pin 26 engages the threaded inner surface 37 of the cuff 36 and is drawn into the bore 44 of the handle. As shown in FIGS. 3 and 4, the flexible stem 25 can be fully retracted into the handle 12 such that a majority of the partially threaded pin 26 rests in the bore 44 and the collar 24 of the neck meets the rotatable cuff 36. In this position, the flexibility of the neck 22 is severely limited. Accordingly, as the flexible stem 25 of the neck is projected from the handle 12 and more of the flexible stem is exposed, the degree to which the flexible stem can bend increases and it will flex from the central position under less force. Similarly, as the flexible stem 25 of the neck 22 is retracted into the handle 12, the degree of flexibility in the stem decreases. In this manner, the user is able to selectively control the degree of flexibility in the neck 22 using the rotatable cuff 36.

FIGS. 5, 6, and 7 illustrate another improvement for the razor 10' of the present invention. Specifically, the razor 10' is provided with a removable flume 28 that is attachable to the collar 24' and is used to direct a stream of water into the blade cartridge 16'. As more clearly depicted in FIG. 6, the flume 28 comprises a semicircular trough 30 that partially encompasses the collar 24' and extends beneath the mounting arms 18' as they protrude from the collar 24'. The flume 28 also includes a substantially V-shaped funneling plane 32 that slopes downwardly beneath the mounting arms and extends between the mounting arms 18' and the blade cartridge 16'. As shown more clearly in FIG. 7, the V-shaped funneling plane 32 includes a pair of edges 34 that rise upwardly from the funneling plane 32 so as to surround the mounting arms 18' when the flume 28 is attached to the collar 24' of the razor. Further, when attached, the V-shaped funneling plane 32 does not contact the blade cartridge 16'. Thus, the blade cartridge 16' is still capable of pivoting around the prongs 20' of the mounting arms 18'.

The flume 28 is attached to the collar 24' by a pair of tabs 31 that extend upwardly from the semicircular trough 30. In the preferred embodiment of the present invention, the collar 24' of the razor 10' is molded to form a groove 33. The flume 28 is attached to the razor by inserting the collar 24 between the tabs 31 of the trough 30 and snapping the tabs into the groove 33, thereby securing the flume 28 to the razor 10'. Similarly, to remove the flume from the razor, the user merely pulls the collar 24' from between the tabs 33. It will be readily apparent to those of ordinary skill in the art that the above-described flume may also be permanently attached to the razor 10' or that the flume may be attached anywhere on the razor 10'. Although the flume is preferably made of a lightweight, clear plastic, those of ordinary skill in the art will recognize that the flume can also be made from such hard, durable, rust-resistant materials as lightweight surgical steel.

To rinse the razor 10' the user simply places the razor under a stream of water from the faucet. The substantially V-shaped funneling plane 32 receives the normally circular-shaped water stream from the faucet and converts it into a rectangular-shaped stream corresponding to the shape of the blade cartridge 16'. Since the blade cartridge 16' is secured to the razor 10' by the mounting arms 18' at the ends 17' of the blade cartridge, the rectangular-shaped water stream flows directly through the blade cartridge 16' and rushes between and around the blades unimpeded by any obstruction. The edges 34 of the flume 28 prevent any of the water from escaping under the mounting arms 18'. When finished rinsing, the user may either continue shaving unimpeded by the flume 28 or may remove the flume 28 from the razor 10'.

While a number of preferred embodiments of the invention have been illustrated and described, it will be appreciated that various changes can be made therein without departing from the spirit and scope of the invention. For example, it will be readily apparent to those skilled in the art that the funneling plane described above may be any shape, including both functional and aesthetic shapes, as long as the funneling plane extends between the mounting arms. In addition, the mounting arms may be of any configuration, including curved or nonsloping, as long as the mounting arms secure the ends of the blade cartridge.

The embodiments of the invention in which an exclusive property or privilege is claimed are defined as follows:

1. A razor capable of receiving a stream of water in order to facilitate easy rinsing, the razor comprising:

(a) a blade cartridge having opposing ends;

(b) an elongated handle having a first end and a second end;

(c) a neck adjustably mounted to the first end of the handle, the neck having:

(i) a collar;

(ii) a flexible stem coupled to the collar; and (iii) a threaded pin coupled to the flexible stem, the threaded pin extending into the first end of the handle; and (d) a pair of mounting arms extending from the neck, the mounting arms securing the ends of the blade cartridge.

2. The razor of claim 1, wherein the neck is adjustably mounted to the first end of the handle by a rotatable cuff, the cuff being coupled to the first end of the handle such that the threaded pin extends through the cuff and into the first end of the handle, the cuff including a threaded inner surface that engages the threaded pin such that turning the rotatable cuff moves the flexible stem of the neck into and out of the cuff.

3. The razor of claim 2, wherein the cuff is coupled to the first end of the elongated handle by a joint which allows the cuff to rotate with respect to the elongated handle.

4. The razor of claim 1, further comprising a flume attached to the collar, the flume comprising a funneling plane that extends between the mounting arms and the blade cartridge such that the funneling plane receives the stream of water and converts it to a substantially rectangular-shaped stream of water capable of flowing through the blade cartridge.

5. The razor of claim 4, the flume further comprising a pair of edges that rise upwardly from the funneling plane so as to surround the mounting arms.

6. The razor of claim 1, wherein the mounting arms flare outwardly from the collar and slope downwardly and away from each other forming a substantially V-shaped space between the mounting arms.

7. A razor capable of funneling a stream of water in order to facilitate easy rinsing, the razor comprising:

a blade cartridge having opposing ends;

an elongated handle having a first end and a second end;

a neck adjustably mounted to the first end of the handle;

mounting arms extending from the neck and securing the ends of the blade cartridge; and a flume attached to the razor between the handle and the blade cartridge, the flume including a funneling plane extending between the mounting arms and the blade cartridge such that the funneling plane receives the stream of water and converts it to a substantially rectangular-shaped stream of water that is directed by the funneling plane into the blade cartridge.

8. The razor of claim 7, the neck further comprising:

a collar through which the mounting arms extend;

a flexible stem coupled to the collar; and a threaded pin mounted to the flexible stem, the thread pin extending into the first end of the handle.

9. The razor of claim 8, wherein the mounting arms flare outwardly from the collar and slope downwardly in opposing directions forming a substantially V-shaped space between the mounting arms.

10. The razor of claim 8, wherein the flume further comprising:

a trough partially surrounding the collar and extending beneath the mounting arms as the mounting arms protrude outwardly from the collar;

a pair of tabs rising upwardly from the trough and partially surrounding the collar such that the flume is removably attached to the collar; and a pair of edges rising up from the plane and surrounding the mounting arms.

11. The razor of claim 10, wherein the collar includes a groove into which the tabs of the flume are secured.

12. The razor of claim 10, wherein the neck is adjustably mounted to the handle by a rotatable cuff, the cuff being coupled to the first end of the handle such that the threaded pin extends through the cuff and into the first end of the handle, the cuff including a threaded inner surface that engages the threaded pin such that turning the rotatable cuff propels the threaded pin through the cuff and moves the flexible stem of the neck into and out of the cuff.

13. The razor of claim 12, wherein the cuff is coupled to the first end of the elongated handle by a joint which allows the cuff to rotate axially with respect to the elongated handle.

14. The razor of claim 7, each opposing end of the blade cartridge sloping inwardly to form a fastening point.

15. The razor of claim 14, each of the mounting arms including a prong that engages a fastening point of the blade cartridge such that the blade cartridge is pivotally mounted at its fastening points to the mounting arms.

16. A razor capable of receiving a stream of water in order to facilitate easy rinsing, the razor comprising:

(a) a blade cartridge having opposing ends;

(b) an elongated handle having a first end and a second end;

(c) a flexible neck adjustably mounted to the first end of the handle; the flexible neck including:

(i) a collar;

(ii) a flexible stem coupled to the collar; and (iii) a threaded pin coupled to the flexible stem, the threaded pin extending into the first end of the handle; and (d) a handle attachment extending from the neck and securing the blade cartridge.

17. The razor of claim 16, wherein the neck is adjustably mounted to the first end of the handle by a rotatable cuff, the cuff being coupled to the first end of the handle such that the threaded pin extends through the cuff and into the first end of the handle, the cuff including a threaded inner surface that engages the threaded pin such that turning the rotatable cuff moves the flexible stem of the neck into and out of the cuff.

18. The razor of claim 17, wherein the cuff is coupled to the first end of the elongated handle by a joint which allows the cuff to rotate with respect to the elongated handle.

19. The razor of claim 16, wherein the handle attachment further comprises mounting arms which extend from the neck and secure the ends of the blade cartridge.

20. The razor of claim 18, wherein the mounting arms flare outwardly from the collar and slope downwardly and away from each other forming a substantially V-shaped space between the mounting arms.

21. The razor of claim 18, each of the mounting arms including a prong that secures an end of the blade cartridge.

22. The razor of claim 19, further comprising a flume attached to the collar, the flume comprising a funneling plane that extends between the mounting arms and the blade cartridge such that the funneling plane receives the stream of water and converts it to a substantially rectangular-shaped stream of water capable of flowing through the blade cartridge.

23. The razor of claim 22, the flume further comprising a pair of edges that rise upwardly from the funneling plane so as to surround the mounting arms.

* * * * *

UNITED STATES PATENT AND TRADEMARK OFFICE

CERTIFICATE OF CORRECTION

PATENT NO. : 5,600,887

DATED : February 11, 1997

INVENTOR(S) : B. Olson

It is certified that error appears in the above-indentified patent and that said Letters Patent is hereby corrected as shown below:

| COLUMN | LINE | |
|---|---|---|
| 6 (Claim 10, | 46 line 1) | After "of claim 8," delete "wherein" |
| 8 (Claim 20, | 10 line 1) | "of claim 18," should read --of claim 19,-- |
| 8 (Claim 21, | 14 line 1) | "of claim 18," should read --of claim 19,-- |

Signed and Sealed this

Eighth Day of July, 1997

Bruce Lehman

*Attest:*

BRUCE LEHMAN

*Attesting Officer*

*Commissioner of Patents and Trademarks*